US005978410A

United States Patent [19]

Johansen et al.

[11] Patent Number: 5,978,410

[45] Date of Patent: Nov. 2, 1999

[54] METHOD FOR PRODUCTION OF CARBON ELECTRODES

[75] Inventors: Johan Arnold Johansen; Reidar Ugland, both of Kristiansand, Norway

[73] Assignee: Elkem ASA, Norway

[21] Appl. No.: 08/913,450

[22] PCT Filed: Mar. 1, 1996

[86] PCT No.: PCT/NO96/00043

§ 371 Date: Aug. 26, 1997

§ 102(e) Date: Aug. 26, 1997

[87] PCT Pub. No.: WO96/27276

PCT Pub. Date: Sep. 6, 1996

[30] Foreign Application Priority Data

Mar. 2, 1995 [NO] Norway ..... 950807

[51] Int. Cl.[6] ..... H05B 7/107

[52] U.S. Cl. ..... 373/89; 373/92

[58] Field of Search ..... 373/88–97; 29/825

[56] References Cited

U.S. PATENT DOCUMENTS

| | | | |
|---|---|---|---|
| 3,819,841 | 6/1974 | Persson | 373/89 |
| 4,133,968 | 1/1979 | Frolov | 373/89 |
| 4,527,329 | 7/1985 | Bruff et al. | 29/825 |
| 4,575,856 | 3/1986 | Persson | 373/89 |
| 4,612,151 | 9/1986 | Bruff et al. | 264/105 |
| 4,692,929 | 9/1987 | Cavigli et al. | 373/89 |
| 4,696,014 | 9/1987 | Orrling | 373/89 |

FOREIGN PATENT DOCUMENTS

| | | |
|---|---|---|
| 327741 | 8/1989 | European Pat. Off. . |
| 116153 | 7/1968 | Norway . |
| 149451 | 10/1979 | Norway . |
| 154860 | 1/1987 | Norway . |

*Primary Examiner*—Tu Ba Hoang
*Attorney, Agent, or Firm*—Bierman, Muserlian and Lucas

[57] ABSTRACT

The present invention relates to a method for production of carbon electrodes where a first unbaked carbonaceous electrode paste containing a binder which cures at a temperature below 500° C. is supplied to an annulus between a curing chamber having an inner cross section corresponding to the cross section of the electrode which is to be produced and an inner mould material, curing of the first electrode paste by means of supplying heat to the curing chamber, removing of elongated sections of the cured first electrode paste from the curing chamber. The lengths of the cured first electrode paste are mounted on the top of the electrode column in an electric smelting furnace, a second electrode paste is optionally supplied to the central opening of the cured body of the first electrode paste, whereby the cured body of the first electrode paste and the second electrode paste are baked into a solid carbon electrode in the area of supplying electric operating current to the electrode.

20 Claims, 6 Drawing Sheets

METHOD FOR PRODUCTION OF CARBON ELECTRODES

TECHNICAL FIELD

The present invention relates to method for production of carbon electrodes for the use in electric smelting furnaces.

BACKGROUND ART

In electric smelting furnaces for production of ferro alloys, ferro phosphorus, pig iron, and other products it is to day mainly used self-baking carbon electrodes. Conventional self-baking electrodes comprise a vertical arranged electrode casing normally made from steel, extending through an opening in the furnace roof or hood. The upper end of the electrode casing is open in order to allow addition of unbaked carbonaceous electrode paste which upon heating softens and melts and is thereafter baked into a solid carbon electrode due to heat evolved in the paste in the area of supply of electric operating current to the electrode. As the electrode is consumed in the furnace the electrode is lowered and new sections of casing are installed on the top of the electrode column and further unbaked electrode paste is added.

Conventional electrodes of this type are equipped with inner, vertical metallic ribs affixed to the inner surface of the electrode casing which ribs extend radially towards the centre of the electrode. When a new section of electrode casing is installed at the top of the electrode column, the ribs are welded to the ribs in the casing below in order to obtain continuous ribs in vertical direction. The ribs serve as a reinforcement for the baked electrode and to conduct electric current and heat radially into the electrode paste during the baking process. To compensate for the consumption of the electrode, the electrode is lowered downwardly into the furnace by means of electrode holding and slipping means.

When conventional electrodes of this type are used, the electrode casing and the inner ribs melt when the electrode is being consumed in the furnace. The metal content of the casing and the ribs is thus transferred to the product produced in the smelting furnace. As the electrode casing and the inner ribs usually are made from steel, such conventional self-baking electrodes can not be used for electric smelting furnaces for the production of silicon or for the production of ferro-silicon having a high silicon content, as the iron content in the produced product will become unacceptably high.

For processes where iron contaminates the product to be produced it has conventionally been used prebaked carbon electrodes which are produced in suitable lengths outside the smelting furnace and added to the top of the electrode column by means of threads or threaded nipples. It is also known to use modifications of conventional self-baking electrodes where contamination of the product in the furnaces with iron from the casing and the ribs are avoided or reduced.

Pre-baked electrodes are normally produced by forming sections of electrodes from a carbonaceous electrode paste, whereafter the formed complete electrode sections are subjected to heat treatment in order to bake the electrode paste into a solid carbon electrode. Such a method of production requires a long period of heat treatment and the temperature has to be closely regulated during heating and during cooling in order to prevent crack formation in the finished electrode length. Further, the baked electrode has to be machined in order to obtain an acceptable surface finish and to make threads in the ends of each electrode length. Prebaked electrodes produced in this way are therefore very costly.

In Norwegian patent No. 154860 it is disclosed a method for continuous production of elongated carbon bodies which bodies are cut into suitable lengths and which are used in the same way as prebaked electrodes after machining and threading. In this method electrode paste supplied to a casing is baked by lowering the casing containing unbaked electrode paste continuously or substantially continuously through a baking furnace which is heated to a temperature of between 700 and 1300° C. by external supply of heat and by combustion of gases which evolve during the baking. Also this kind of electrodes have the disadvantage that they have to be machined and treaded before they can be used as electrodes in smelting furnace.

A number of modifications of the conventional self-baking electrode have been proposed in order to avoid contamination of the product produced in the smelting furnace. Thus in Norwegian patent No. 149451 it is disclosed a self-baking electrode wherein an electrode paste with a tar-based binder contained in a casing having no inner vertical ribs, is baked above the area where electric operating current is supplied to the electrode and where the casing is removed after baking of the electrode, but before the electrode reaches the area where electric operating current is supplied to the electrode. In this way a casing and rib free electrode can be produced. This kind of electrode has been used in smelting furnaces for the production of silicon, but has the disadvantage compared to conventional prebaked electrodes that it needs costly apparatuses for baking of the electrode as the electrode in the area of baking has to be heated to a temperature in the range of 700–1000° C. Further, as gases containing polyaromatic hydro-carbon compounds (PAH) evolve during baking, the apparatus has to be equipped with means for collecting and destructing the PAH compounds. Finally, it has to be arranged devices for removal of the casing after the electrode has been baked.

U.S. Pat. No. 4,692,929 discloses a self-baking electrode which is useful in the production of silicon. The electrode comprises a permanent metal casing having no inner ribs and a support structure for the electrode comprising carbon fibres, where the electrode paste is baked about the support structure and where the baked electrode is held by the support structure. This electrode has the disadvantage that separate holding means have to be arranged above the top of the electrode in order to hold the electrode by means of the support structure made from carbon fibres.

U.S. Pat. No. 4,575,856 discloses a self-baking electrode having a permanent casing having no inner ribs where the electrode paste is baked about a central graphite core and where the electrode is held be the graphite core. This electrode has the same disadvantage as the electrode disclosed in U.S. Pat. No. 4,692,929, but in addition the graphite core is subjected to breakage when the electrode is subjected to horizontal forces.

The above mentioned methods for producing self-baking electrodes having no inner metal ribs all have the disadvantage the they can not be used for electrodes having a diameter above about 1.2 m without a substantial increased risk of electrode breakage. In contrast, conventional self baking electrodes may have a diameter of up to 2.0 m.

In the production of all the above mentioned types of carbon electrodes it is used a carbonaceous electrode paste comprising a particulate solid carbon material, preferably anthracite, and a tar-based binder. This electrode paste is solid at room temperature. Upon heating, the paste starts to soften at a temperature in the range of 50–150° C. as the tar-based binder starts to melt at this temperature. Upon further heating to about 500° C. the paste starts to bake, and a complete baking to a solid carbonaceous body takes place at a temperature above about 800° C.

DISCLOSURE OF INVENTION

In spite of the above mentioned methods and apparatuses for production of self-baking electrodes in order to avoid iron contamination of the product which is produced in the furnace, it is still a need for a reliable method and apparatus for production of self-baking carbon electrodes whereby the disadvantages of the known methods can be overcome.

Accordingly, the present invention relates to a method for production of a carbon electrodes which method is characterised in that a first unbaked carbonaceous electrode paste containing a binder which cures at a temperature below 500° C. is supplied to a an annulus between a curing chamber having an inner cross-section corresponding to the cross-section of to the electrode which is to be produced and an inner mould material, curing of the first electrode paste by means of supplying heat to the curing chamber, removing of elongated sections of the cured first electrode paste from the curing chamber, installing lengths of the cured first electrode paste on the top of the electrode column in an electric smelting furnace, optionally supplying a second electrode paste to the central opening of the cured body of the first electrode paste, whereby the cured body of the first electrode paste and the second electrode paste are baked into a solid carbon electrode in the area of supplying electric operating current to the electrode.

According to a first embodiment the inner mould material is made from metal, carbon or from a ceramic material which is removed after curing of the first electrode paste. An elongated cured body having a central opening extending therethrough is thereby formed. The cured body is then mounted on the top of the electrode column in an electric smelting furnace, whereafter the second carbonaceous electrode paste, preferably containing a tar-based binder, is supplied to the central opening in the cured body of the first electrode paste. As the electrode is consumed in the furnace, the electrode is slipped downwards through conventional electrode holding—and slipping means, and when the cured body of the first electrode paste reaches the area of the electrode electric current supply means, the cured body and the second electrode paste contained in the cured body are baked into a monolithic solid carbon electrode.

According to a second embodiment the inner mould material in the curing chamber consists of unbaked blocks of the second electrode paste containing a binder which cures a higher temperature than the binder in the first electrode paste, preferably a tar-based binder. During heating and curing of the first electrode paste, the blocks of the second electrode paste will be substantially unaffected. The cured body of the first electrode paste which is removed form the curing chamber will thereby contain unbaked blocks of the second electrode paste in its centre. When the cured body is mounted at the top of the electrode column of the smelting furnace, the blocks of the second electrode paste are baked in the area where electric current is supply to the electrode and forms a monolithic solid electrode with the cured body of the first electrode paste.

The production of the cured body of the first electrode paste can be both discontinuous and continuous. By discontinuous production the annulus between the curing chamber and the inner mould material is filled with the first electrode paste whereafter heat is supplied to the curing chamber for a time necessary to effect curing of the first electrode paste. After cooling, the cured body of the first electrode paste is removed from the curing chamber whereafter the curing chamber again is filled with the first electrode paste for production of another cured body.

By continuous production of cured bodies of the first electrode paste, the heat supply to the curing chamber is kept substantially constant and the cured body is lowered through the curing chamber at a constant or substantially constant rate, while unbaked electrode paste is supplied to the annulus between the curing chamber and the inner mould material. When the inner mould material comprises blocks of the second electrode paste, new blocks of the second electrode paste are placed on the top of the lower blocks in order to maintain the mould material in the curing chamber as the cured body is lowered down through the curing chamber. By continuous production of the cured bodies of the first electrode paste, the continuous body is divided into suitable lengths below the curing chamber, preferably by inserting horizontal partition sheets in the curing chamber at suitable intervals.

The bodies of the cured first electrode paste is mounted on the top of the electrode column by using conventional glue for gluing carbon parts. In order to ensure a good connection and centering of the bodies of the first electrode paste to each other when mounting on the electrode column, the bodies of the cured first electrode paste are made with a ring-shaped upwardly extending bulb in one end and with a corresponding ring-shaped groove in the other end, whereby the bulb on one cured body is intended to fit into the groove on the next cured body. In this way the contact area upon gluing is increased at the same time as the stability against horizontal forces is increased when the bodies are mounted in the electrode column in a melting furnace.

The bulbs respectively the grooves, can in a simple way be made by forming bulbs and grooves on the partition sheets which are used during the continuous production of the cured bodies of the first electrode paste.

The first electrode paste is preferably an electrode paste containing a resin-based binder. Such binders cure at a temperature between 120° C. and 500° C. and during curing it is obtained bodies having a sufficient mechanical strength in order to withstand the forces they are subjected to in an electrode column in electric smelting furnaces. The cured bodies of the first electrode paste will have a sufficient electric and thermal conductivity in order to supply electric current via conventional current supply means in the area of supplying electric operating current to the electrode.

The radial thickness of the cured body of the first electrode paste is adjusted according to the electrode diameter with an increased thickness with increased electrode diameter. It is, however, preferred that the radial thickness is at least 1 cm. The cured body of the first electrode paste has, however, normally a radial thickness of at least 5 cm and preferably more than 10 cm.

The carbon electrode according to the present invention shows a number of advantages compared to known carbon electrodes. Thus the electrode has no iron casing and no iron ribs and can therefore be used in processes where iron will contaminate the product produced in the furnace. The electrode will, after final baking in the area of electric current supply to the electrode, have no joints, as the second electrode paste in the centre of the electrode will from a true continuous electrode. The risk of electrode breakage is thereby substantially reduced compared to prebaked electrodes where each electrode length is mounted on the electrode column by means of thread connections. Further the use of a resin-based paste as the first electrode paste provides a smooth surface during curing of the body of the first electrode paste in the curing chamber, making it unnecessary to machine the outer surface.

The electrode produced according to the present invention can be installed in existing furnaces as existing holding and slipping equipment and electric current supply means can be used without modifications.

DETAILED DESCRIPTION OF PREFERRED EMBODIMENTS

Figure 1:
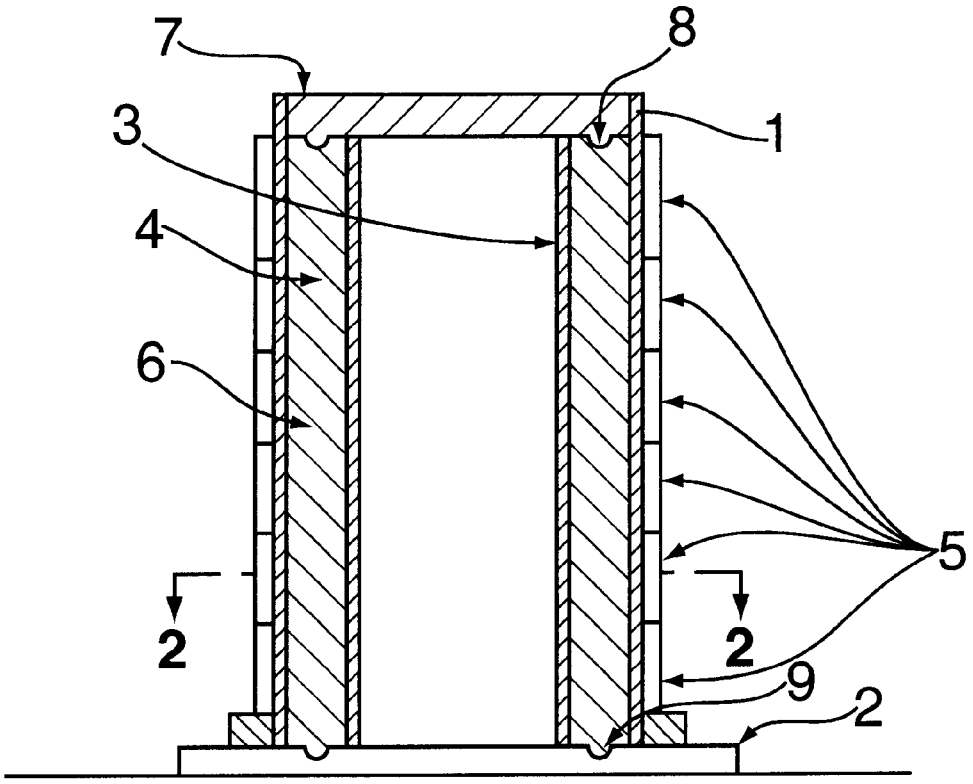
FIG. 1 shows a first embodiment for production of cured bodies of the first electrode paste.
Figure 2:
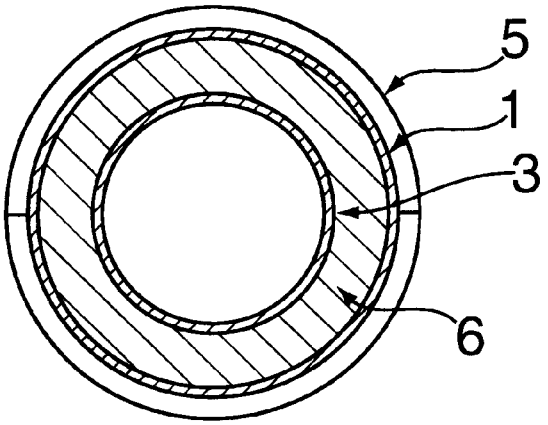
FIG. 2 is a view along line I—I in FIG. 1.

In FIG. 1 and 2 there is shown schematically discontinuous production of cured bodies of a first electrode paste.

In FIG. 1 and 2 there is shown a curing chamber 1 having an inner diameter corresponding to the electrode to be produced. The curing chamber 1 rests on a base support 2. An inner mould material 3 forms an annular elongated mould 4 between the curing chamber 1 and the inner mould material 3. A first electrode paste containing a binder which cures at a temperature of below 500° C., preferably a resin-based binder, is filled into the mould 4, whereafter the paste is heated to curing, temperature by means of electric heating elements 5 or by other known heating means for supply of heat energy, arranged in the curing chamber 1, whereby the first electrode paste is cured to a ring-shaped cured body 6. In order to ensure that a horizontal surface is obtained the top of the cured body 6, a horizontal sheet 7 is placed upon the top of the first electrode paste prior to curing. The horizontal sheet 7 has preferably a ring-shaped bulb 8 on its lower side in order to from a ring-shaped groove in the cured body 6, and a ring shaped groove on its upper side in order to form a downward extending bulb in the cured body 6. After cooling the cured body 6, is removed from the curing chamber 1.

Figure 3:
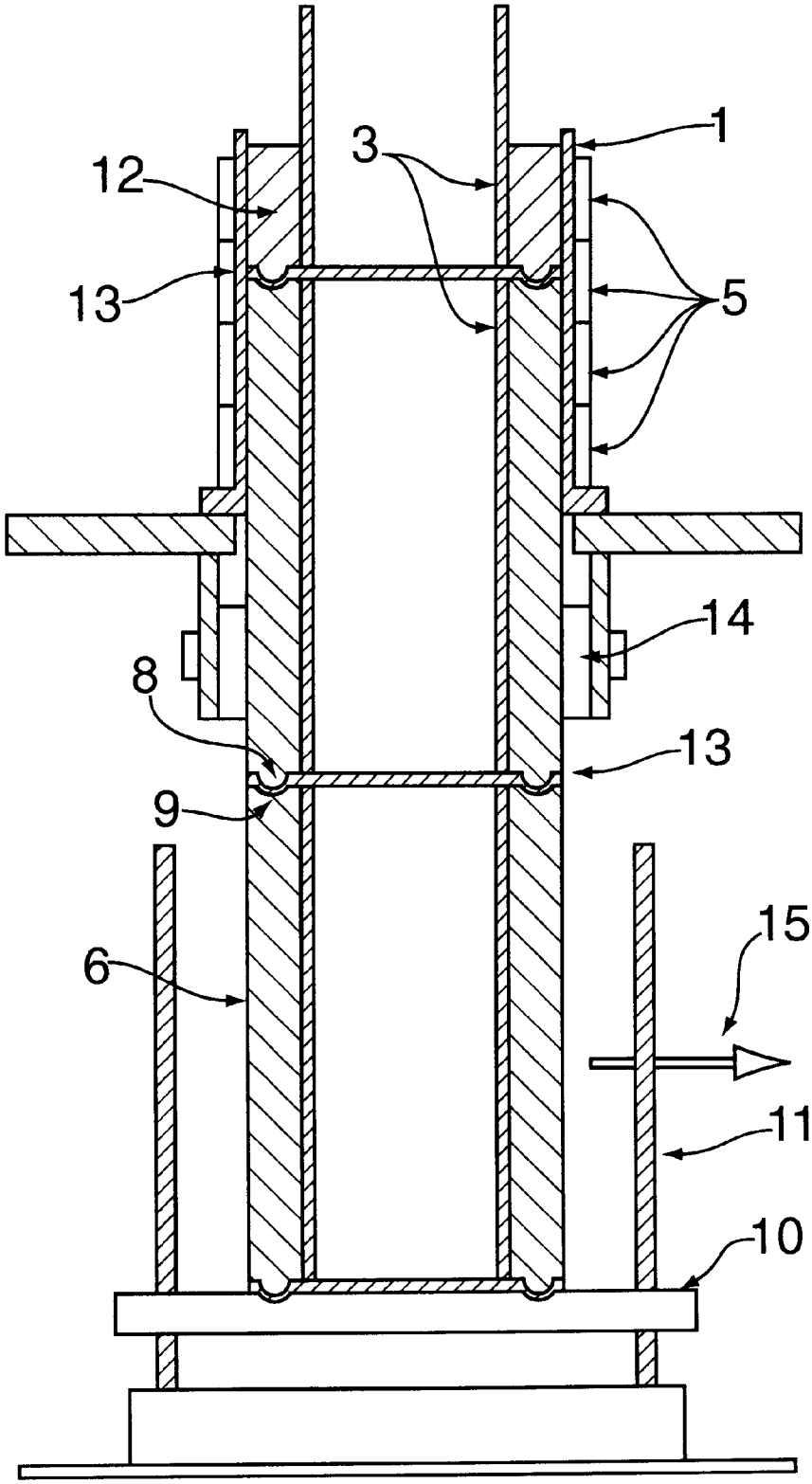
FIG. 3 shows a second embodiment for production of cured bodies of the first electrode paste.

In FIG. 3 there is shown continuous production of cured bodies 6 of the first electrode paste. In FIG. 3 parts corresponding to parts in FIGS. 1 and 2 have identical reference numerals. The method shown in FIG. 3 differs from the method shown in FIGS. 1 and 2 in that the cured body 6 rests on a table 10 which can be moved in vertical direction. The table 10 can be moved vertically by means of threaded spindles 11. At start of the curing the table 10 is in its upper position constituting a bottom in the curing chamber 1. The first electrode paste 12 is supplied to the annulus between the curing chamber 1 an the inner mould material 3 whereafter the electrode paste is heated by means of heat energy supplied by the heating elements 5 in the curing chamber 1.

When the curing starts, the table 10 is lowered with a constant or a substantially constant rate while further electrode paste 12 is supplied to the top of the curing chamber 1. In order to divide the cured body into suitable lengths, partition sheets 13 is inserted at intervals. When the table 10 has been lowered such a distance that one length of cured body 6 has been completely lowered down through the curing chamber 1, the part of the cured body 6 inside the curing chamber 1 is held by means of pressure means 14, whereafter the table 10 with the finished cured body 6 is removed as suggested by the arrow 15. The table 10 is thereafter lifted to its upper position, whereafter lowering of the table 10 with cured body 6 is continued.

The partition sheets 13 is at its upper side equipped with a ring shaped groove 8 and is on its lower side equipped with a downwardly extending ring-shaped bulb in order to form a groove respectively bulb in the top and in the bottom of each of the cured bodies 6.

Figure 4:
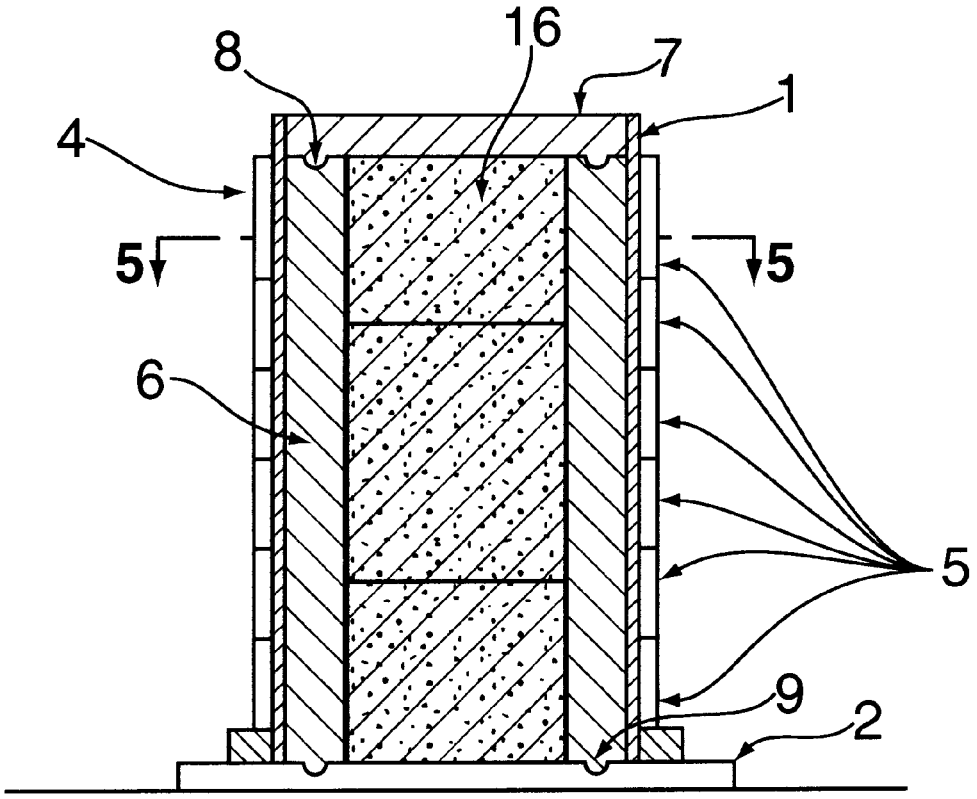
FIG. 4 shows a third embodiment for production of cured bodies of the first electrode paste.
Figure 5:
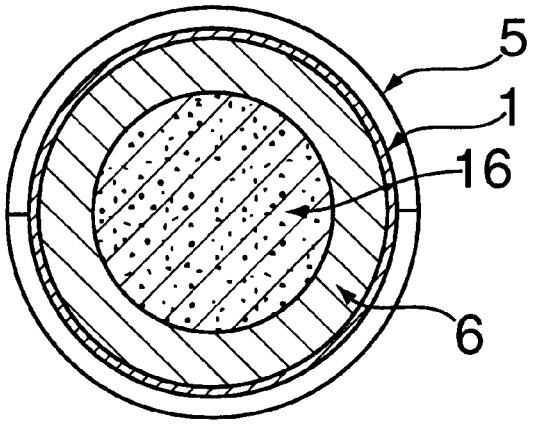
FIG. 5 shows a view along line II—II in FIG. 4.
Figure 6:
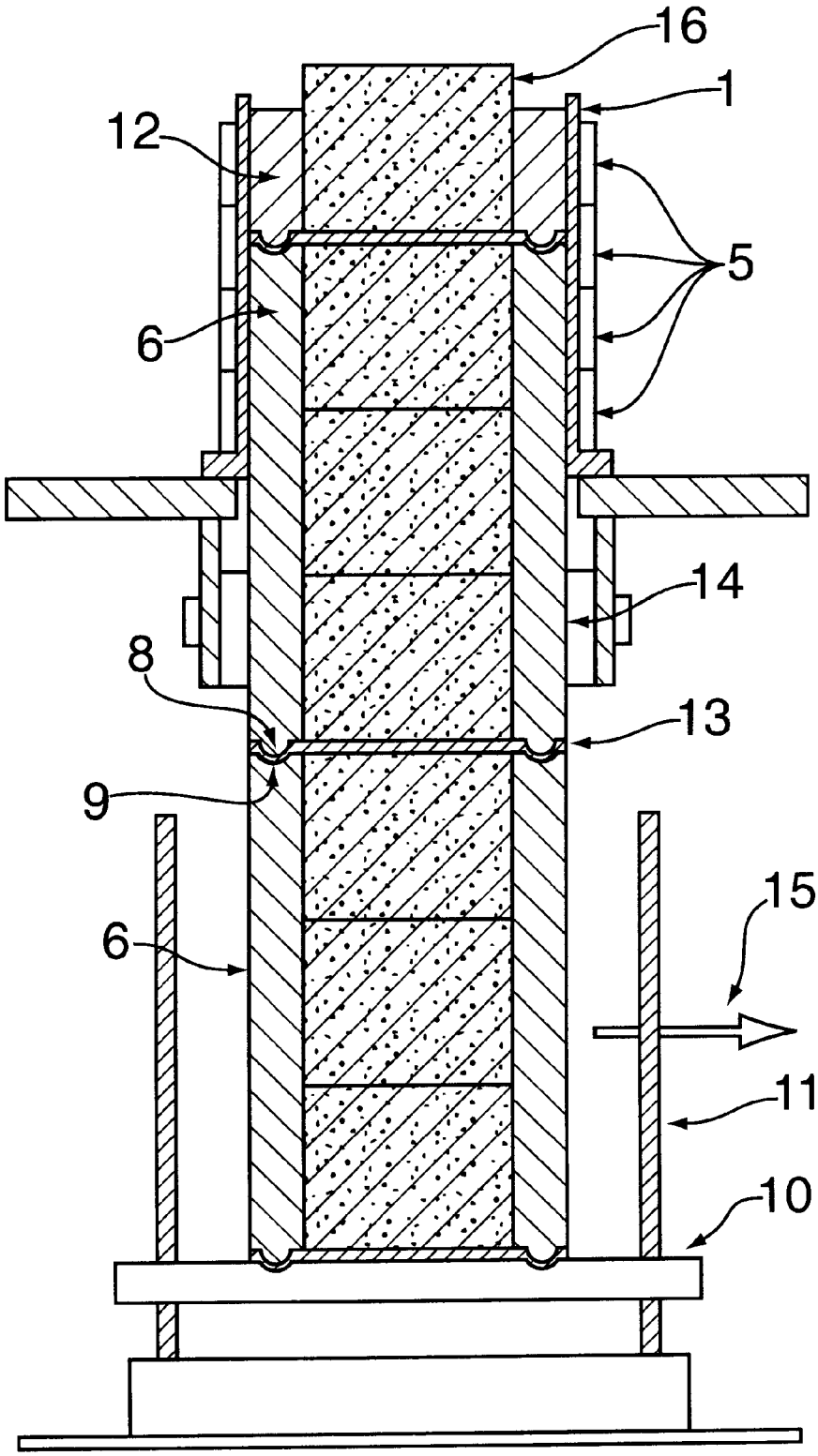
FIG. 6 shows a fourth embodiment for production of cured bodies of the fist electrode paste.

In FIGS. 4,5 and 6 there is shown an embodiment for discontinuous, respectively continuous production of cured bodies 6 which only differs from the embodiments shown in FIGS. 1 and 3 in that the inner mould material is made from blocks 16 of a second carbonaceous electrode paste containing a binder which cures at a higher temperature than the binder in the first electrode paste. During curing of the first electrode paste in the curing chamber 1 the blocks 16 of the second electrode paste are substantially unaffected. The blocks 16 will thereby form an integral central part of the cured bodies 6.

Figure 7:
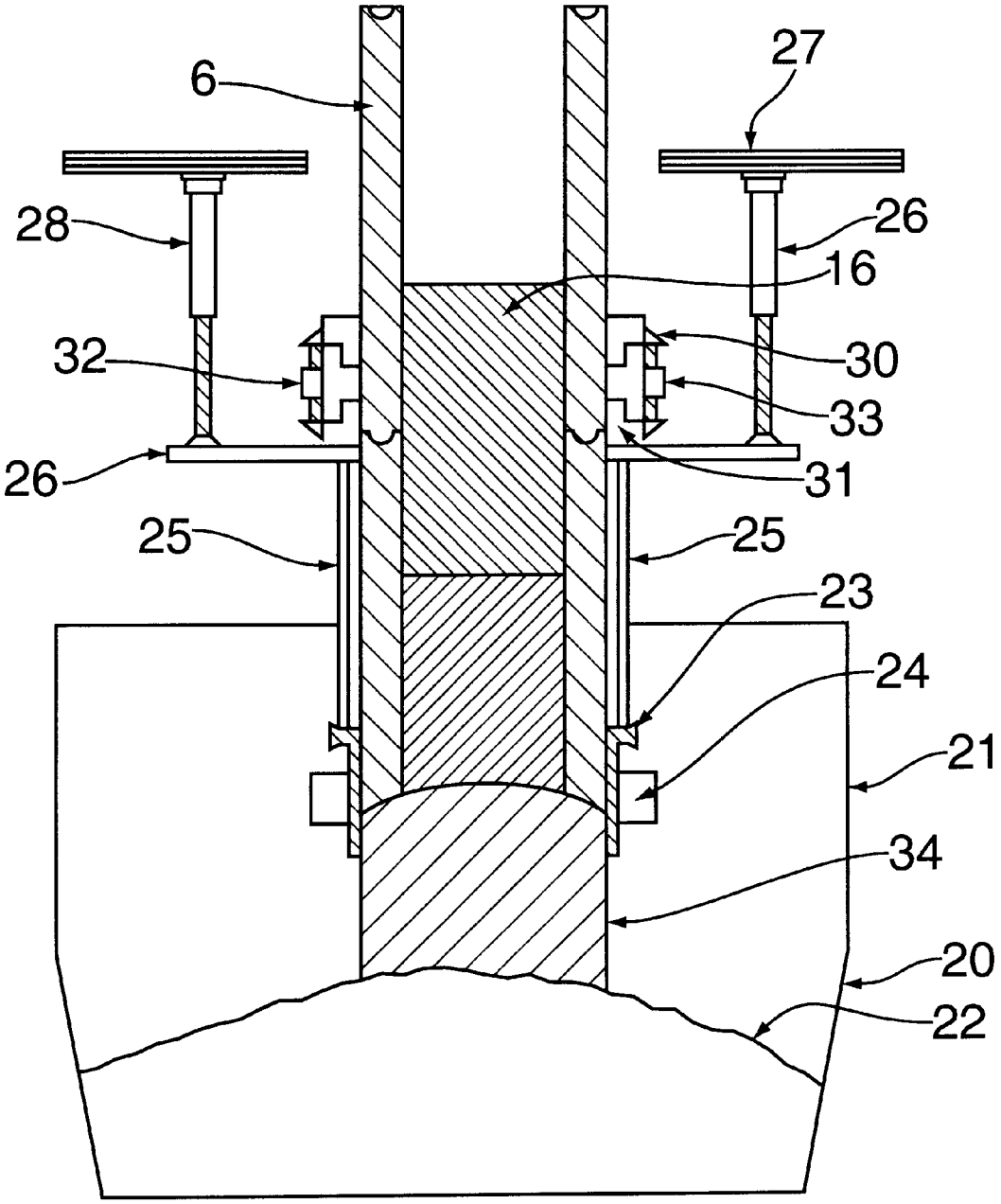
FIG. 7 shows a first embodiment for mounting the cured bodies and final production of electrodes in connection with a smelting furnace, and where.

In FIG. 7 there is shown an embodiment for mounting of the cured bodies 6 produced by the methods shown in FIGS. 1 and 3 on the top of an electrode column in an electric smelting furnace, and final production of the carbon electrode.

On FIG. 7 there is shown in electric smelting furnace 20. The smelting furnace 20 is equipped with a smoke-hood 21 and the charge level in the furnace is suggested by reference number 22. Contact clamps for supply of electric operating current to the furnace are shown by reference numeral 23. The contact clamps 23 are pressed against the electrode by means of a pressure ring 24. The contact clamps 23 and the pressure ring 24 is in conventional way equipped with internal channels for circulation of a cooling liquid. The contact clamps 23 are via rails 25 suspended from an electrode frame 26.

The electrode frame 26 is in conventional way suspended in the building construction 27 by means of hydraulic electrode regulation cylinders 28, 29. On the electrode frame 26 there is further arranged electrode holding and slipping rings 30, 31. The upper holding and slipping ring 30 can be moved in vertical direction by means of hydraulic or pneumatic cylinders 32,33.

Cured bodies 6, produced according to the embodiments shown in FIGS. 1 and 3 as described above, are mounted on the top of the electrode column and connected to the cured body 6 below by gluing. Electrode paste in the form of briquettes or cylinders is charged to the hollow cured bodies 6. When the electrode paste enters the area of the contact clamps 23 for supply of electric operating current to the furnace 20, heat will be generated in the cured body 6 and in the electrode paste. The cured body 6 and the electrode paste contained therein will thereby be baked into a solid monotithic carbon electrode 34.

Figure 8:
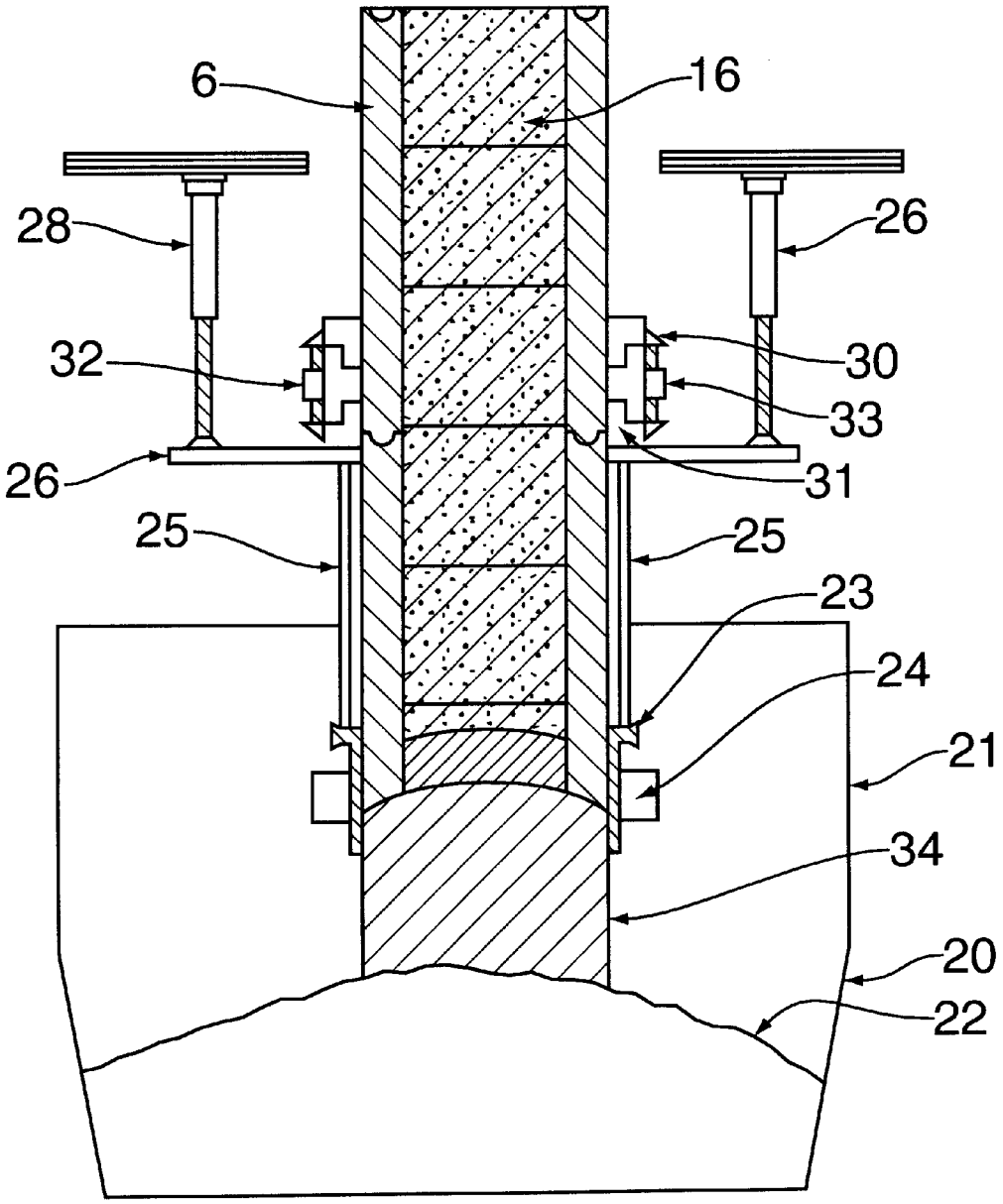
FIG. 8 shows a second embodiment for mounting and final production of electrode in connection with a smelting furnace.

In FIG. 8 there is shown an embodiment for mounting of cured bodies 6 produced according to the method shown in FIG. 4 and 6 to the top of the electrode column in an electric smelting furnace. In FIG. 8 parts corresponding to parts in FIG. 7 have been given the same reference numerals. In the embodiment shown in FIG. 8 the cured bodies 6 are mounted in the same way as described above in connection with FIG. 7. The cured bodies 6 arena however, already filled with blocks 16 of the second electrode paste. When the cured bodies 6 enters the area of the contact clamps 23, the cured bodies 6 and the blocks 16 of the second electrode paste will be baked into a solid monolithic carbon electrode 34.

We claim:

1. A method for production of a carbon electrode, comprising the steps of:

supplying a first unbaked carbonaceous electrode paste containing a binder which cures at a temperature below about 500° C. to an annulus defined by an inner wall of a curing chamber and an inner mold material, said curing chamber having an inner cross-section corresponding to the cross-section of the electrode which is to be produced, curing of the first electrode paste by means of supplying heat to the curing chamber so as to form a cured body from the first electrode paste, said cured body having a central opening therein, removing the cured body from the curing chamber, installing the cured body on the top of an electrode in an electric smelting furnace, supplying a second electrode paste to the central opening of the cured body, supplying operating electric current to the electrode whereby the cured body and the second electrode paste are baked into a solid carbon electrode in the area electric current is supplied to the electrode.

2. The method according to claim 1, wherein the inner mold material is made from metal, carbon or a ceramic material which is removed after curing of the first electrode paste.

3. A method for production of a carbon electrode comprising the steps of:

supplying a first unbaked carbonaceous electrode paste containing a binder which cures at a temperature below about 500° C. to an annulus defined by an inner wall of a curing chamber and one or more unbaked blocks of a second electrode paste containing a binder which cures at a higher temperature than the binder in the first electrode paste, said curing chamber having an inner cross-section corresponding to the cross-section of the electrode which is to be produced, curing of the first electrode paste by means of supplying heat to the curing chamber so as to form a cured body from the first electrode paste said second electrode paste being substantially uneffected during the heating and curing of the first electrode paste in the curing chamber, removing the cured body and said blocks of uncured second electrode paste from the curing chamber, installing the cured body and said blocks on the top of an electrode in an electric smelting furnace, supplying operating electric current to the electrode whereby the cured body and the uncured blocks of said second electrode paste are baked into a solid carbon electrode in the area electric current is supplied to the electrode.

4. The method according to claim 1 wherein the cured body is produced by completely filling the annulus between the curing chamber and the inner mold material with the first electrode paste, whereafter heat is supplied to the curing chamber for a time necessary to effect curing of the first electrode paste and removing the cured body of the first electrode paste from the curing chamber, whereafter the annulus of the curing chamber again is filled with the first electrode paste for production of another cured body.

5. The method according to claim 1 wherein the cured body of the first electrode paste is produced by keeping the heat supply to the curing chamber substantially constant and lowering the cured body through the curing chamber at a constant or substantially constant rate, while further uncured first electrode paste is supplied to the annulus between the curing chamber and the inner mold material.

6. The method according to claim 5 wherein the cured body of the first electrode paste is divided into suitable lengths below the curing chamber.

7. The method according to claim 6 wherein the cured body is divided into suitable lengths by inserting horizontal partition sheets in the curing chamber at suitable intervals.

8. The method according to claim 1 wherein the cured body is mounted on the top of the electrode in the electric smelting furnace by gluing.

9. The method according to claim 3 wherein the cured body and said blocks of uncured second electrode paste is produced by completely filling the annulus between the curing chamber and the uncured second electrode paste with the first electrode paste, whereafter heat is supplied to the curing chamber for a time necessary to effect curing of the first electrode paste, and removing the cured body and said blocks of uncured second electrode paste from the curing chamber, whereafter the curing chamber again is filled with the first electrode paste and said blocks of uncured second electrode paste for production of another cured body and blocks of uncured said second electrode paste.

10. The method according to claim 3 wherein the cured body and said blocks of uncured second electrode paste is produced by keeping the heat supply to the curing chamber substantially constant and lowering the cured body and said blocks of uncured second electrode paste through the curing chamber at a constant or substantially constant rate, while further blocks of uncured second electrode paste is supplied to the curing chamber to form the annulus and uncured first electrode paste is added to the annulus.

11. The method according to claim 3 wherein the cured body and said blocks of uncured second electrode paste is divided into suitable lengths below the curing chamber.

12. The method according to claim 11 wherein the cured body and said blocks of uncured second electrode paste is divided into suitable lengths by inserting horizontal partition sheets in the curing chamber at suitable intervals.

13. The method according to claim 3 wherein the cured body and said blocks of uncured second electrode paste is mounted on the top of the electrode column in the electric smelting furnace by gluing one cured body to another cured body.

14. A carbon electrode comprising:

(a) a top portion comprising:

(a1) a cured body of a first electrode paste wherein said first electrode paste cured at a temperature below about 500° C., said cured body having a central opening therein; and (a2) an uncured second electrode paste, said second electrode paste curing at a temperature above the temperature at which said first electrode paste, said second electrode paste being located in said central opening of the cured body; and (b) a bottom portion comprising a solid monolithic carbon electrode.

15. The electrode of claim 14 wherein said cured body has a thickness of at least 5 cm.

16. A carbon electrode precursor used for making an electrode in a furnace comprising:

a cured body of a first electrode paste wherein said first electrode paste cured at a temperature below about 500° C., said cured body having a central opening therein; and one or more blocks of an uncured second electrode paste, said second electrode paste curing at a temperature above the temperature at which said first electrode paste, said second electrode paste being located in said central opening of the cured body.

17. The electrode of claim 16 wherein said cured body has a thickness of at least 5 cm.

18. In an electric smelting furnace which employs one or more electrodes, the improvement comprising a carbon electrode having (a) a top portion which comprises:

(a1) a cured body of a first electrode paste wherein said first electrode paste cured at a temperature below about 500° C., said cured body having a central opening therein; and (a2) an uncured second electrode paste, said second electrode paste curing at a temperature above the temperature at which said first electrode paste, said second electrode paste being located in said central opening of the cured body; and (b) a bottom portion which is a monolithic carbon electrode.

19. The furnace of claim 18 wherein said cured body of said electrode has a thickness of about 5 cm.

20. The furnace of claim 18 wherein silicon metal is produced.

* * * * *